US006213335B1

(12) United States Patent
Wilson

(10) Patent No.: US 6,213,335 B1
(45) Date of Patent: Apr. 10, 2001

(54) STACKABLE CONTAINER WITH INTERNAL DIVIDER

(76) Inventor: Patrick Thomas Wilson, BOX 682, Cochrane, Alberta (CA), T0L 0W0

( * ) Notice: Subject to any disclaimer, the term of this patent is extended or adjusted under 35 U.S.C. 154(b) by 0 days.

(21) Appl. No.: 09/425,995

(22) Filed: Oct. 25, 1999

(51) Int. Cl.[7] ..... B65D 21/02

(52) U.S. Cl. ..... 220/552; 220/528; 220/532; 206/517

(58) Field of Search ..... 220/552, 533, 220/532, 529, 528, 530, 23.6; 215/6; 206/515, 516, 517, 519

(56) References Cited

U.S. PATENT DOCUMENTS

| | | | | |
|---|---|---|---|---|
| 1,912,505 | * | 6/1933 | Weston | 220/552 |
| 3,689,051 | * | 9/1972 | Miller | 266/275 |
| 4,272,768 | * | 6/1981 | Rookard, Jr. | 342/7 |
| 4,538,737 | * | 9/1985 | Delaney | 211/71.01 |
| 4,572,374 | * | 2/1986 | Sirotkin | 206/518 |
| 5,198,127 | * | 3/1993 | Tilley et al. | 220/552 |
| 5,806,708 | * | 9/1998 | Schwab | 220/552 |

FOREIGN PATENT DOCUMENTS

| | | | | |
|---|---|---|---|---|
| 527986 | * | 1/1957 | (BE) | 220/533 |
| 262021A1 | * | 3/1988 | (EP) | 220/552 |

* cited by examiner

*Primary Examiner*—Stephen Castellano
(74) *Attorney, Agent, or Firm*—David S. Thompson

(57) ABSTRACT

A stackable container with internal divider includes a container body having a tapered sidewall and base panel is particularly suitable for use with crushed ice drinks. First and second divider panels are movable between a stacking mode and a use mode. In the stacking mode, the first and second divider panels are substantially parallel, and are bent to conform to the inside surface of the sidewall of the container body. In the stacking mode, the container bodies may stacked in a nested manner, in which the inside surface of a lower cup contacts the outside surface of an upper cup, and the first and second divider panels of the lower cup are carried in the stacking mode configuration between the two cups. In the use mode, the first and second divider panels are oriented substantially perpendicularly to each other. In the use mode, four quarter cavities are defined within the cavity defined within the container body.

2 Claims, 5 Drawing Sheets

FIG. 8
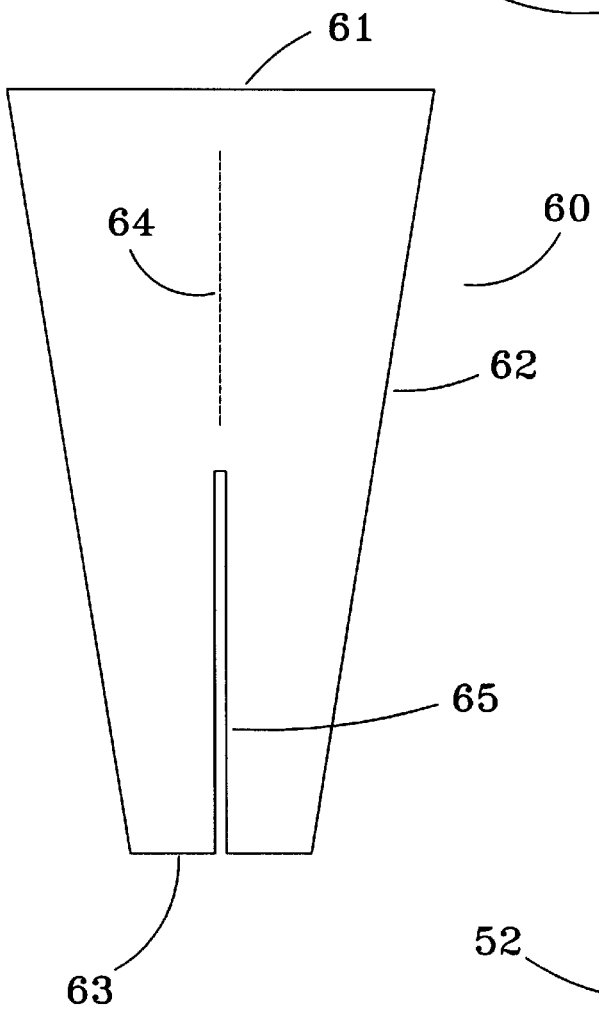
FIG. 9
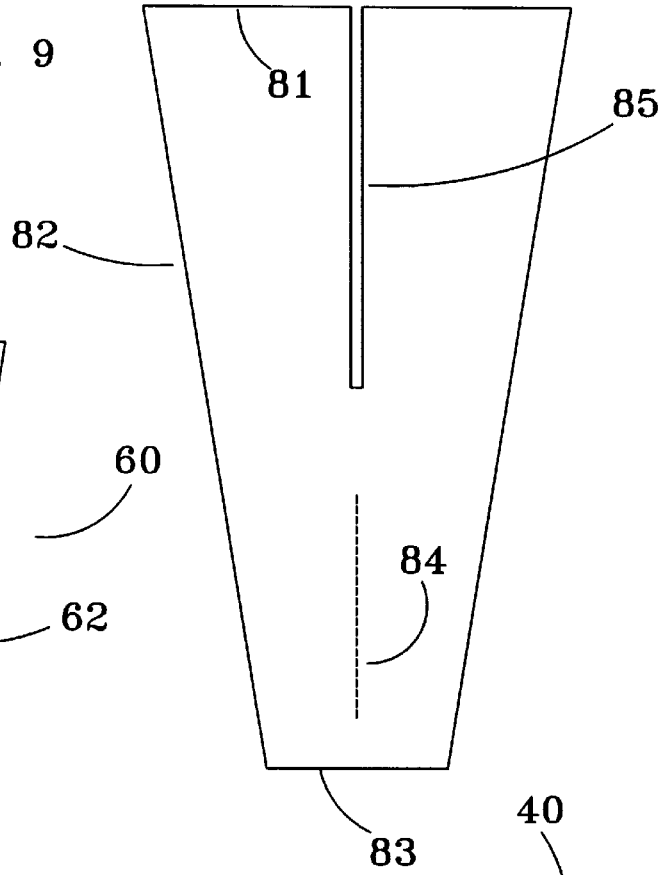
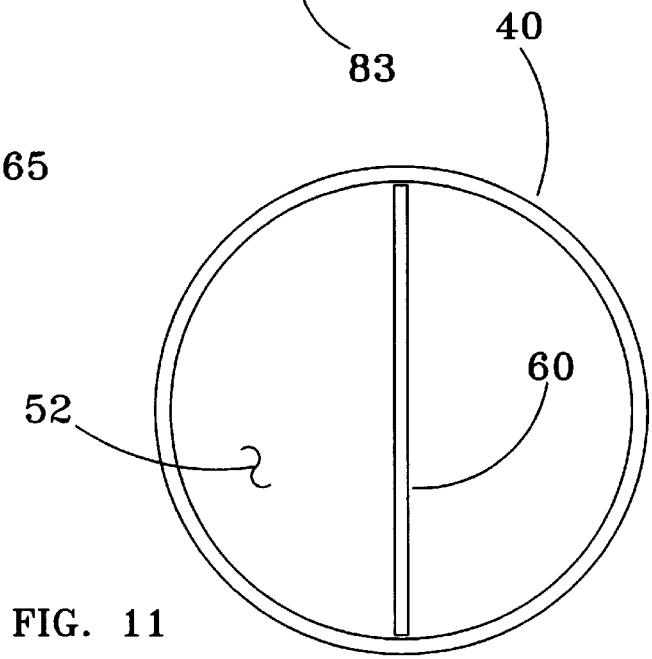
FIG. 11

STACKABLE CONTAINER WITH INTERNAL DIVIDER

CROSS-REFERENCES

There are no applications related to this application filed in this or any foreign country.

BACKGROUND

Multi-chamber containers are well known in certain applications. For example, as seen in U.S. Pat. No. 5,593,052 issued to McGee in 1997, a baby bottle with two separate fluid chambers is known. Such a bottle allows two fluids, such as milk and juice, to be dispensed from a single container having a single nipple.

Similarly, a number of multi-compartment containers, such as U.S. Pat. Nos. 4,277,000, 4,065,536 and 4,279,349, all disclose rigid containers which may be used to store two distinct fluids.

Nevertheless, known two-compartment containers have failed to disclose a divider structure which is highly adapted for conversion between a stackable container, a two-compartment container or a four-compartment container.

For the foregoing reasons, there is a need for stackable container with an internal divider that is adapted for the formation of two or more individual compartments within the container.

SUMMARY

The present invention is directed to an apparatus that satisfies the above needs. A novel stackable container with internal divider is disclosed that is adapted for transformation of a container between modes in which the container is adapted for stacking, the container is adapted for containment of two distinct fluids and the container is adapted for defining four fluids compartment areas.

The stackable container with internal divider of the present invention provides some or all of the following structures.

(A) A container body having a tapered sidewall, optionally a bottom panel, and an upper rim. A preferred container is made of a paper-based material, typically having a wax-based water resistant coating.

(B) A first divider panel has an upper edge sized incrementally shorter than the diameter of the upper rim of the container body. A lower edge is incrementally shorter than the diameter of the bottom panel. Opposed first and second side edges connect first and second opposed ends of the upper and lower edges, respectively. Where no bottom panel is present, and the sidewalls of the container body taper in a conical configuration to a point, the lower edge may be replaced by a point or very short edge from which the side edges of the panel extend.

A first divider panel slot is defined along a center line, from a middle portion of the panel to a middle point of the lower edge.

(C) A second divider panel has an upper edge sized incrementally shorter than the diameter of the upper rim of the container body. A lower edge is incrementally shorter than the diameter of the bottom panel. Opposed first and second side edges connect first and second opposed ends of the upper and lower edges, respectively. Where no bottom panel is present, and the sidewalls of the container taper in a conical configuration to a point, the lower edge may be replaced by a point or very short edge from which the side edges of the panel extend.

A second divider panel slot is defined along a center line, from a middle portion of the panel to a middle point of the upper edge.

(D) The divider panels are assembled together in a manner in which the first divider panel slot is slid over the center line of the second divider panel, and in which the second divider panel slot is slide over the center line of the first divider panel.

(E) The assembled divider panels are inserted into the container body in either a stacking mode or a use mode. In the stacking mode, the first and second divider panels are moved together, against one side of the inside surface of the container body. In the use mode, the assembled divider panels are separated and oriented perpendicularly to each other.

It is therefore a primary advantage of the present invention to provide a novel stackable container with internal divider that is easily stackable in a nested manner.

Another advantage of the present invention is to provide a novel stackable container with internal divider that is easily converted from a stacking mode to two-compartment or four-compartment modes.

A still further advantage of the present invention is to provide a novel stackable container with internal divider that may be manufactured in pointed-bottom or squared-off bottom designs.

DRAWINGS

These and other features, aspects, and advantages of the present invention will become better understood with regard to the following description, appended claims, and accompanying drawings where:

FIG. 8 is a front orthographic view of the first divider panel.

FIG. 9 is a front orthographic view of the second divider panel.

FIG. 11 is a top view of a third embodiment of the stackable container with internal divider having one divider panel and two half cavities.

DESCRIPTION

Figure 1:
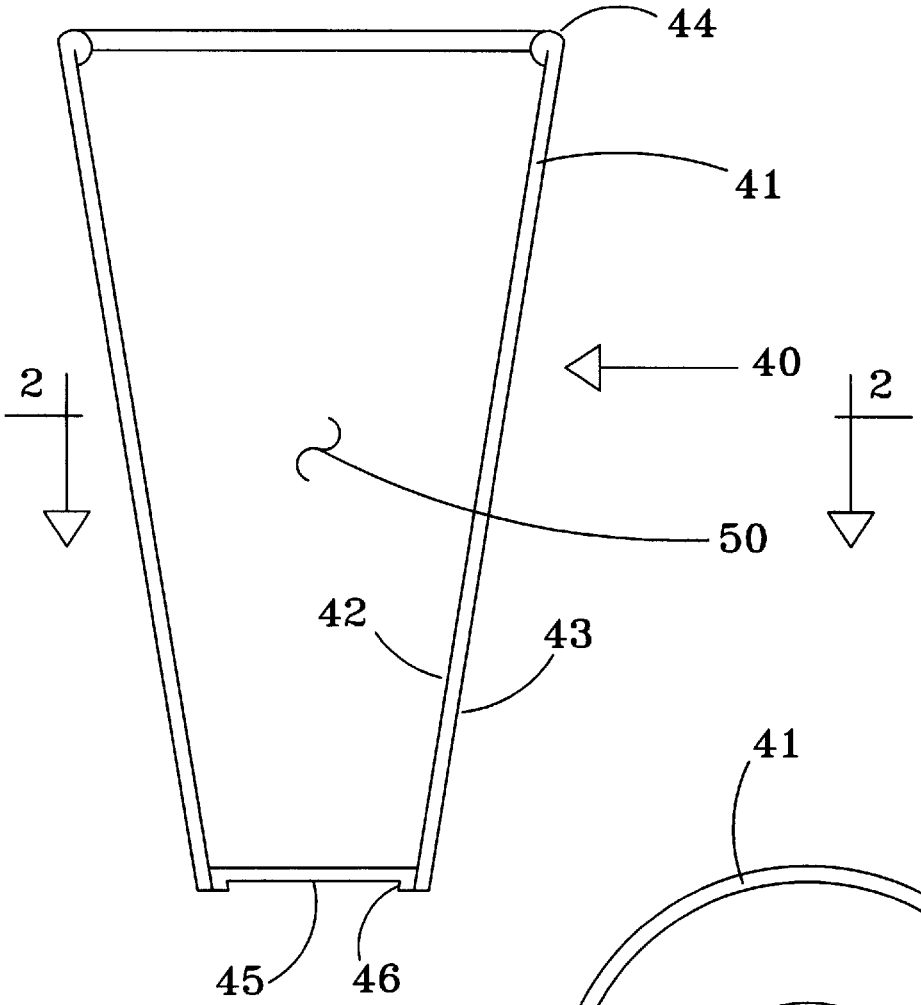
FIG. 1 is a side cross-section view of a version of the container body.
Figure 2:
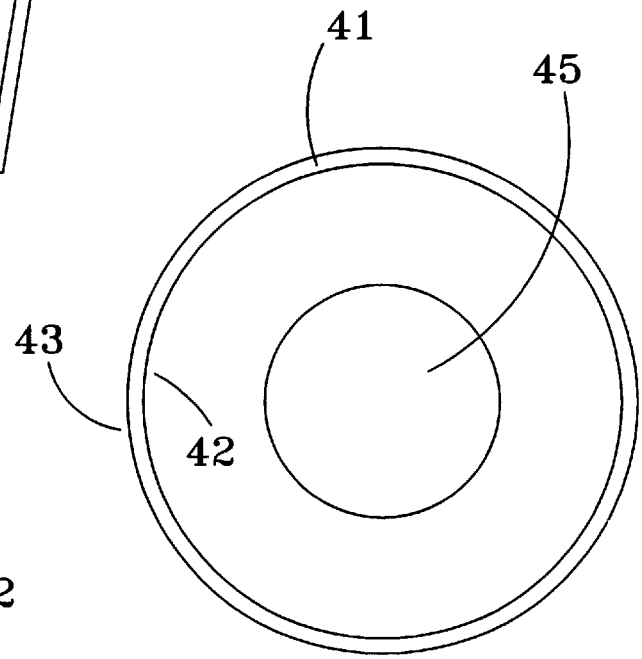
FIG. 2 is a top view of the container body of FIG. 1.

Referring in generally to FIGS. 1 thorough 9, a stackable container with internal divider 20 constructed in accordance with the principles of the invention is seen. As seen in FIGS. 1 and 2, a container body 40 having a tapered sidewall 41 and base panel 45 is sized and constructed particularly for use with crushed ice drinks. First and second divider panels 60, 80 are movable between a stacking mode and a use mode. In the stacking mode, the first and second divider panels are substantially parallel, and are bent to conform to the inside surface of the sidewall of the container body. In the stacking mode, the container bodies may stacked in a nested manner, in which the inside surface of a lower cup contacts the outside surface of an upper cup, and the first and second divider panels of the lower container are carried in the stacking mode configuration between the two containers. In the use mode, the first and second divider panels are oriented substantially perpendicularly to each other. In the use mode, four quarter cavities are defined within the cavity defined within the container body.

As seen in FIGS. 1 and 2, a container body 40 provides a tapered sidewall 41 defining an internal cavity 50. The sidewall has an inside surface 42 and an outside surface 43. An upper portion of the sidewall defines a lip 44, which may be rolled or otherwise reinforced.

A peripheral flange 46 defined about the perimeter of the base panel 45 is attached to a lower opening of the tapered sidewall, providing a water-resistant seal.

A preferred version of the container body is manufactured of water resistant paper product, typically coated with wax or similar material.

Referring particularly to FIG. 8, a first divider panel 60 is seen. The first divider panel is made of planar material similar to that of the container body 40. A top edge 61 is incrementally shorter in length than the diameter of the upper rim or lip 44 of the container body. A lower edge 63 is incrementally shorter than the diameter of the bottom panel. Opposed first and second side edges 62 connect first and second opposed ends of the upper and lower edges, respectively.

A first divider panel slot 65 is defined along a lower portion of a center line 64, which divides the first divider panel into mirror-image halves. As seen in FIG. 8, the slot extends from a middle portion of the panel to a middle point of the lower edge.

Figure 10:
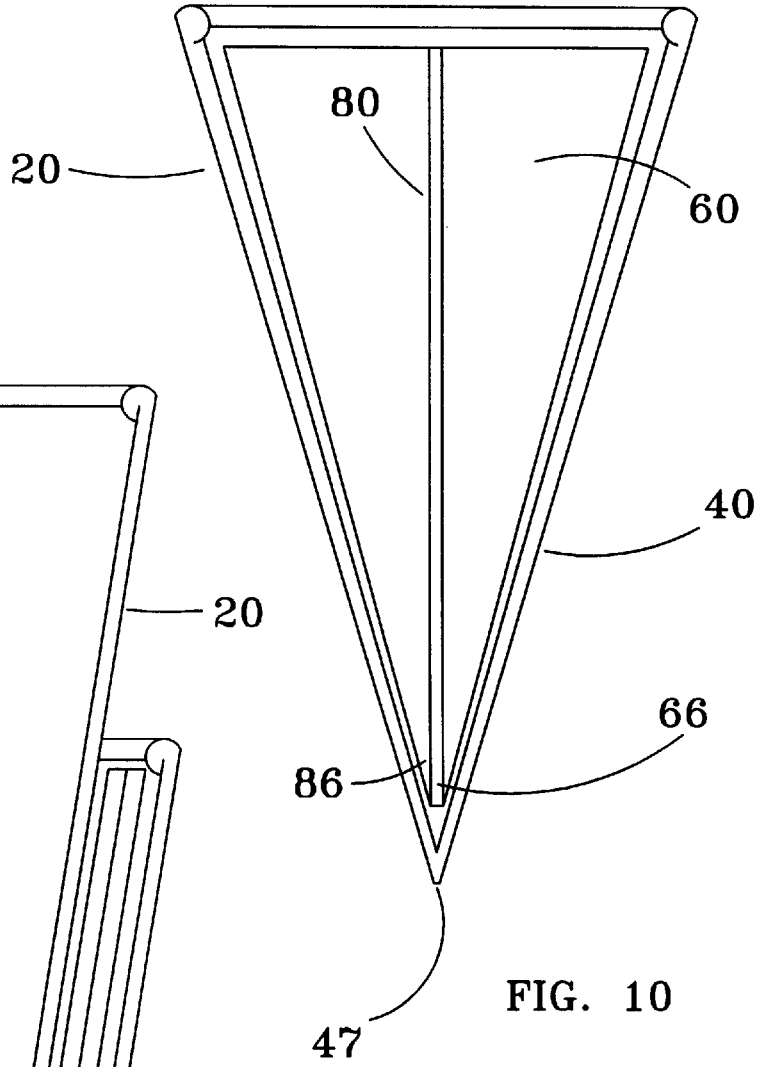
FIG. 10 is a side cross-sectional view of a second embodiment of the stackable container with internal divider having a container body having a pointed bottom.

As seen in FIG. 10, where no bottom panel is present, and the sidewalls 41 of the container body 40 taper in a conical configuration to a point, the lower edge may be replaced by a point 66 or very short edge from which the side edges 62 of the panel extend.

Referring particularly to FIG. 9, a second divider panel 80 is seen. The second divider panel is made of planar material similar to that of the container body 40. A top edge 81 is incrementally shorter in length than the diameter of the upper rim or lip 44 of the container body. A lower edge 83 is incrementally shorter than the diameter of the bottom panel. Opposed first and second side edges 82 connect first and second opposed ends of the upper and lower edges, respectively.

A second divider panel slot 85 is defined along an upper portion of a center line 84, which divides the second divider panel into mirror-image halves. As seen in FIG. 9, the slot extends from a middle portion of the panel to a middle point of the upper edge.

Where no bottom panel is present, and the sidewalls 41 of the container body 40 taper in a conical configuration to a point, the lower edge may be replaced by a point 86 or very short edge from which the side edges 82 of the panel extend.

Figure 4:
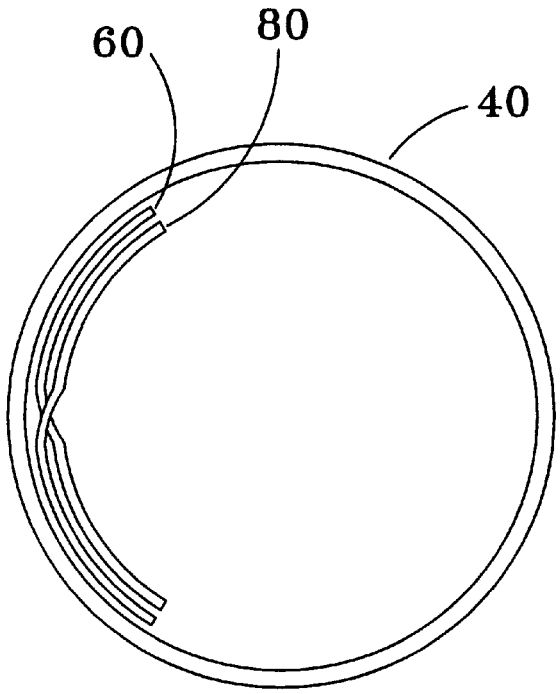
FIG. 4 is a top view of the container body of FIG. 3, taken along the 4—4 lines.
Figure 5:
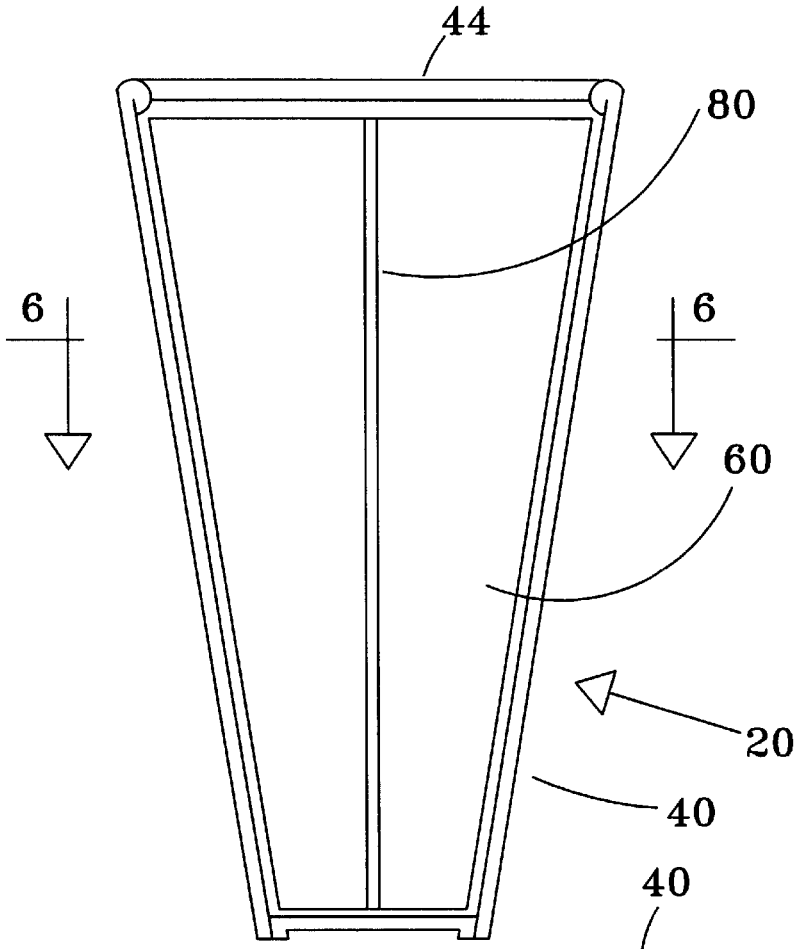
FIG. 5 is a side cross-sectional view of the container body with the first and second divider panels oriented in the use mode.
Figure 6:
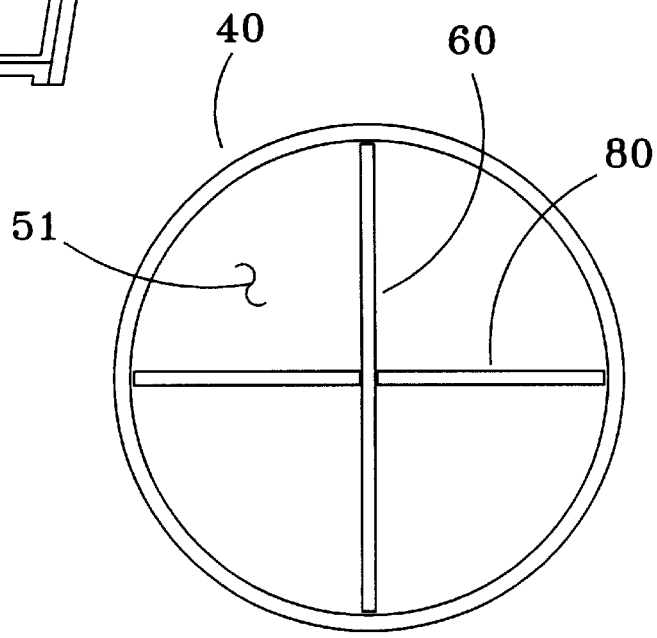
FIG. 6 is a top view of the container body of FIG. 5, taken along the 6—6 lines.

As seen in FIGS. 4, 5 and 6, the first and second divider panels may be connected together. The second divider panel slot 85 is attached to an upper portion of the center line 64 of the first divider panel 60. Similarly, the first divider panel slot 65 is attached to a lower portion of the center line 84 of the second divider panel 80.

Figure 3:
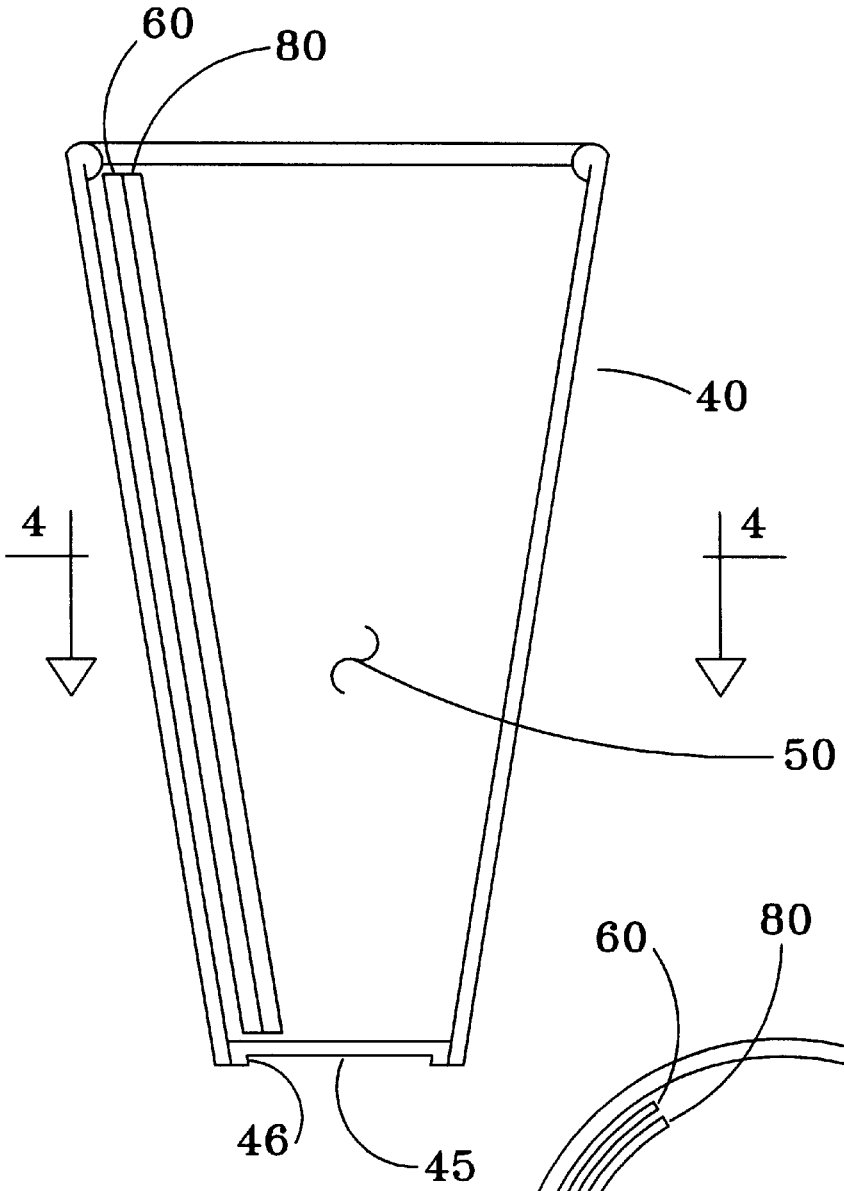
FIG. 3 is a side cross-sectional view of the stackable container with internal divider having a container body with the first and second divider panels oriented in the stacking mode.

As seen in FIGS. 3 and 4, the divider panels 60, 80 may be moved toward the inside surface 42 of the tapered sidewall 41 of the container body 40. With the divider panels moved in this manner, two or more stackable containers with internal dividers 20 may be stacked as seen in the cross-sectional view of FIG. 7.

As seen in FIG. 10, in a second version of the invention, in a stackable container with internal divider 20 where the tapered sidewalls 41 of the container body 40 taper to a point 47, the base panel 45 is eliminated. In this version, the side edges 62, 82 of the first and second panels taper to a point 66, 86.

As seen in FIG. 11, in a third version of the invention, a stackable container with internal divider 20 having only one divider panel results in two half cavities 52. In this version, the internal divider is not required to have a slot. The divider does bend to conform to the inside surface of the container body, in a manner similar to that seen in FIG. 4.

Figure 7:
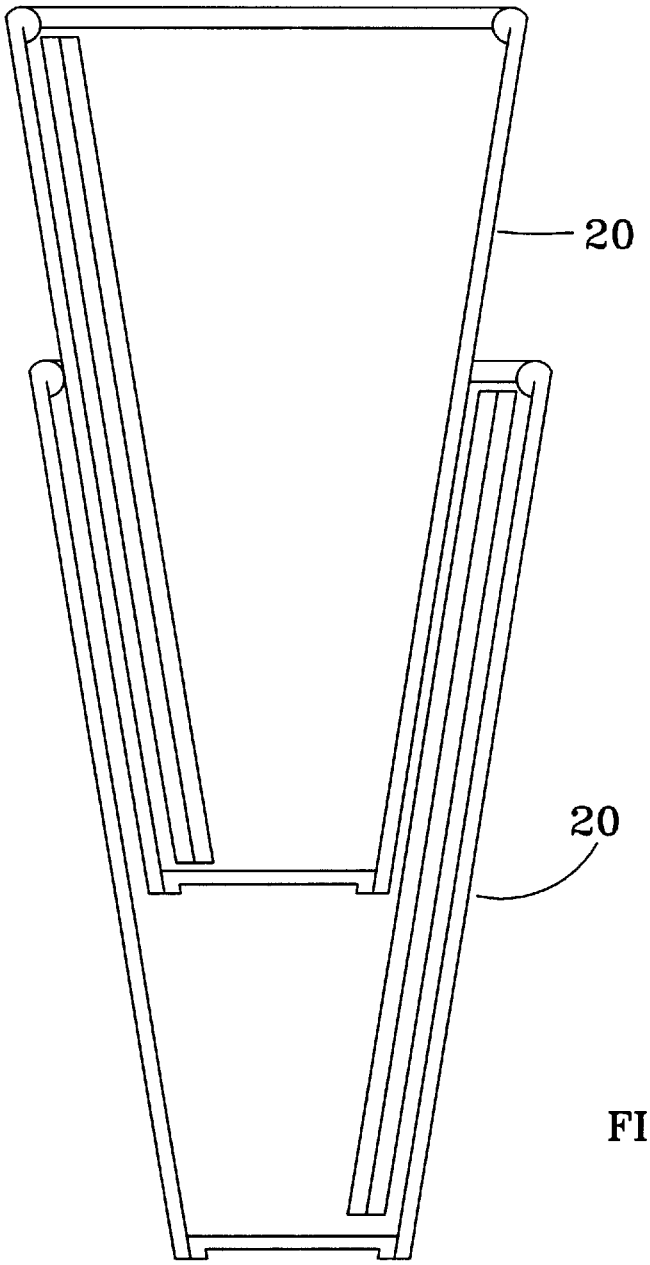
FIG. 7 is a side cross-sectional view of two container bodies with the first and second divider panels in each cup oriented in the stacking mode.

To use stackable container with internal divider 20, the user removes one from the stack seen in FIG. 7. The internal divider, comprising the first and second divider panels 60, 80 is then moved from the orientation seen in FIG. 4 to the orientation seen in FIG. 6. As a result, four quarter cavities 51 are formed. Different flavors of a crushed-ice drink may then be added to each of the four cavities.

The previously described versions of the present invention have many advantages, including a primary advantage of the present invention to providing a novel stackable container with internal divider that is easily stackable in a nested manner.

Another advantage of the present invention is to provide a novel stackable container with internal divider that is easily converted from a stacking mode to two-compartment or four-compartment modes.

A still further advantage of the present invention is to provide a novel stackable container with internal divider that may be manufactured in pointed-bottom or squared-off bottom designs.

The invention resides not in any one of these features per se, but rather in the particular combination of all of them herein disclosed and claimed and it is distinguished from the prior art in this particular combination of all of its structures for the functions specified.

Although the present invention has been described in considerable detail and with reference to certain preferred versions, other versions are possible. For example, while versions of the stackable container with either one or two internal dividers have been disclosed, it is clear that a third internal divider could be added in a manner which would result in six separate compartments. Therefore, the spirit and scope of the appended claims should not be limited to the description of the preferred versions disclosed.

In compliance with the U.S. Patent Laws, the invention has been described in language more or less specific as to methodical features. The invention is not, however, limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

What is claimed is:

1. A stack of identical containers, comprising:

(A) a plurality of identical containers stacked in a nested manner, each container comprising:

(a) a container body comprising a sidewall, a circular bottom panel, and a circular upper rim;

(b) a first divider panel having an upper edge incrementally shorter than the diameter of the upper rim of the container body and a lower edge incrementally shorter than the diameter of the bottom panel, and a first divider panel slot defined along a center line, from a middle portion of the first divider panel to a middle point of the lower edge, the first divider panel contained within the container body;

(c) a second divider panel having an upper edge incrementally shorter than the diameter of the upper rim of the container body and a lower edge incrementally shorter than the diameter of the bottom panel, and a second divider panel slot defined along a center line, from a middle portion of the second divider panel to a middle point of the upper edge; and (d) wherein the first divider panel and the second divider panel are attached together by an interlock formed by an edge surface of the first divider panel slot in contact with a portion of the second center line and formed by an edge surface of the second divider panel slot in contact with a portion of the first center line; and (B) wherein the first and second divider panels are moved together in a stacking mode and positioned between an inside surface of the sidewall of the first container body and an outside surface of a sidewall of a second container body.

2. A stack of identical containers, comprising:

(A) a plurality of identical containers stacked in a nested manner, each container comprising:

(a) a container body comprising a sidewall and a circular upper rim;

(b) a first divider panel having a first upper edge incrementally shorter than the diameter of the upper rim of the container body and a first lower point, and a first divider panel slot defined along a first center line, from a middle portion of the first divider panel to the lower point, the first divider panel contained within the container body;

(c) a second divider panel having a second upper edge incrementally shorter than the diameter of the upper rim of the container body and a second lower point, and a second divider panel slot defined along a second center line, from a middle portion of the second divider panel to a middle point of the upper edge; and (d) wherein the first divider panel and the second divider panel are attached together by an interlock formed by an edge surface of the first divider panel slot in contact with a portion of the second center line and formed by an edge surface of the second divider panel slot in contact with a portion of the first center line; and (B) wherein the first and second divider panels are moved together in a stacking mode and positioned between an inside surface of the sidewall of the first container body and an outside surface of a sidewall of a second container body.

* * * * *